US006716001B2

(12) United States Patent
Kim

(10) Patent No.: US 6,716,001 B2
(45) Date of Patent: Apr. 6, 2004

(54) OIL SUPPLY APPARATUS FOR HERMETIC COMPRESSOR

(75) Inventor: Tae-Min Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/143,766

(22) Filed: May 14, 2002

(65) Prior Publication Data

US 2002/0172607 A1 Nov. 21, 2002

(30) Foreign Application Priority Data

May 18, 2001 (KR) ..... 2001-27390

(51) Int. Cl.[7] ..... F04B 17/00; F04B 35/04

(52) U.S. Cl. ..... 417/363; 417/366; 417/415; 417/424.2; 417/902

(58) Field of Search ..... 417/363, 366, 417/902, 415, 424.2, 423.14, 410.5; 184/6.16, 6.18; 248/621, 618, 593, 594, 603, 604, 611, 613

(56) References Cited

U.S. PATENT DOCUMENTS 2,125,645 A * 8/1938 Money ..... 184/6.18
3,493,168 A * 2/1970 Valbjorn ..... 417/363
3,836,290 A * 9/1974 Carter ..... 417/415
4,118,153 A * 10/1978 Stannow et al. ..... 417/363
4,808,085 A * 2/1989 Nishitsuji ..... 417/363
5,252,038 A * 10/1993 Mangyo et al. ..... 417/363
5,409,358 A * 4/1995 Song ..... 418/63
5,772,410 A * 6/1998 Chang ..... 471/363
6,004,113 A * 12/1999 Vay ..... 417/363
6,450,785 B1 * 9/2002 Dellby et al. ..... 417/410.3

FOREIGN PATENT DOCUMENTS

JP 04-298690 * 10/1992

* cited by examiner

*Primary Examiner*—Justine R. Yu
*Assistant Examiner*—Michael K Gray
(74) *Attorney, Agent, or Firm*—Fleshner & Kim, LLP

(57) ABSTRACT

An oil supply apparatus for a hermetic compressor includes: a crank shaft connected to a rotor of a driving motor so as to be rotated together with the rotor, and having an oil flow path therein; a sleeve connected at a lower end of the crank shaft so as to be rotated integrally together with the crank shaft; a sucking member disposed to maintain a certain gap against an inner circumferential face of the sleeve and sucking oil; and a support bracket installed between support springs installed between a bottom surface of a hermetic container and a stator of the driving motor so that the sucking member can be maintained in a suspended state inside the sleeve, and the sucking member. Since the plurality of legs are fixed as the seat cap is mounted between the support springs, the assembly of the sleeve and the sucking member can be simply assembled in a state that the motor and the compressing unit are already assembled. Thus, its assembling operation is simplified and an efficiency of the assembly operation can be improved.

19 Claims, 3 Drawing Sheets

OIL SUPPLY APPARATUS FOR HERMETIC COMPRESSOR

BACKGROUND OF THE INVENTION

1. Field of the Invention

The present invention relates to an oil supply apparatus for a hermetic compressor, and more particularly, to an oil supply apparatus for a hermetic compressor that is capable of improving an assembly and increasing an oil supply capability.

2. Description of the Background Art

In general, a hermetic compressor, a device for compressing and supplying a fluid, is mainly adopted to a cooling system such as an air-conditioner.

FIG. 1 is a vertical sectional view of a hermetic compressor in accordance with a conventional art.

The conventional hermetic compressor includes: a hermetic container 1 forming a space therein; a driving motor 3 installed inside the hermetic container 1 and providing a driving force; a compressing unit 30 for compressing a fluid with a driving force of the driving motor 3; and an oil supply apparatus 20 for supplying oil into the hermetic container 1 for performing a lubricating and cooling operation.

The motor 3 includes a stator 4 wound with an exciting coil and a rotor 5 made of a permanent magnet.

A support spring 15 is installed at a lower end portion of the stator 4 of the driving motor, in order to elastically support the driving motor 3.

The support spring 15 is installed between a spring seat 18 mounted at a bottom surface of the hermetic container 1 and a spring supporter 17 installed at a lower end portion of the stator 4, in order to elastically support the driving motor 3.

The compressing unit 30 includes: a crank shaft 7 rotated by being connected to the driving motor 3 and having an eccentric portion at its upper portion; a connecting rod 8 for transmitting a rotational force generated according to a rotation of the crank shaft 7; a piston 10 connected to the connecting rod 8 and making a reciprocal movement to compress a fluid; a cylinder 6 in which the piston 10 is inserted so as to be able to make a reciprocal movement, and forming a compressing chamber for compressing the fluid; and a valve assembly 9 disposed at a front side of the cylinder 6 and opening and closing the compressed fluid.

The oil supply apparatus 20 includes an oil flow path 12 formed in a longitudinal direction inside the crank shaft 7 and supplying oil to a sliding part inside the compressor; a sleeve 11 coupled at a lower side of the crank shaft 7 and being rotated together with the crank shaft 7; a sucking member 13 disposed to maintain a certain gap against an inner circumferential face of the sleeve 11, sucking oil through the gap when the sleeve 11 is rotated and supplying the oil to the oil flow path 12; and a supporting bracket 14 for supporting the sucking member 13 so that the sucking member 13 can be maintained with the certain gap with respect to the inner circumferential face of the sleeve 11.

The supporting bracket 14 is formed as an elastic body having a certain elastic force fixed at a lower end of the sucking member 13 and extended to both sides so as to be fixed at a lower side of the stator 4.

That is, the supporting bracket 14 is connected between the sucking member 13 and the stator 4, so as to support the sucking member 13 to maintain the certain gap against the sleeve 11.

The assembling process of the oil supply apparatus of the hermetic compressor in accordance with the conventional art constructed as described above will now be explained.

First, the sleeve 11 is press-fit at a lower inner circumferential face of the crank shaft 7.

After the supporting bracket 14 is fixed at the lower side of the sucking member 13, both end portions of the supporting bracket 14 are fixed at the stator 4 of the motor 3.

The spring supporter 17 is installed at the lower end portion of the stator 4, and the spring seat 18 is installed at the bottom surface of the hermetic container 1. And then, the support spring 15 is installed between the spring supporter 17 and the spring seat 18, thereby completing the assembly.

However, the conventional oil supply apparatus for a hermetic compressor constructed as described above has the following problem.

That is, in the assembling process, the sucking member 13 is inserted into the sleeve 11, the supporting bracket 14 is fixed at the lower side of the sucking member 13, and both end portions of the supporting bracket 14 are fixed at the lower end portion of the stator 4. Thus, the assembling process is complicated.

In addition, since the vibration generated from the motor is directly transferred to the sucking member through the supporting bracket, the gap between the sucking member installed inside the sleeve and the sleeve is difficult to maintain, so that an oil sucking is not smoothly performed.

SUMMARY OF THE INVENTION

Therefore, an object of the present invention is to provide an oil supply apparatus for a hermetic compressor that is capable of improving an assembling process efficiency of a hermetic compressor by rendering a sucking member to be supported by a support spring supporting a stator and by assembling the sucking member and the support unit to a compressor after assembling the sucking member and the support unit as one body in an assembling process of the compressor.

To achieve these and other advantages and in accordance with the purpose of the present invention, as embodied and broadly described herein, there is provided an oil supply apparatus for a hermetic compressor including: a crank shaft connected to a rotor of a driving motor so as to be rotated together with the rotor, and having an oil flow path therein; a sleeve connected at a lower end of the crank shaft so as to be rotated integrally together with the crank shaft; a sucking member disposed to maintain a certain gap against an inner circumferential face of the sleeve and sucking oil; and a support bracket installed between support springs installed between a bottom surface of a hermetic container and a stator of the driving motor so that the sucking member can be maintained in a suspended state inside the sleeve, and the sucking member.

In the oil supply apparatus for a hermetic compressor of the present invention, the support spring includes: an upper spring mounted at the spring support mounted at a lower surface of the stator; and a lower spring mounted at a spring seat mounted at the bottom surface of the hermetic container.

In the oil supply apparatus for a hermetic compressor of the present invention, the support bracket includes a plurality of legs formed in a radial form at a lower end of the sucking member; and a seat cap provided at each end portion of the legs and mounted between the upper spring and the lower spring. The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
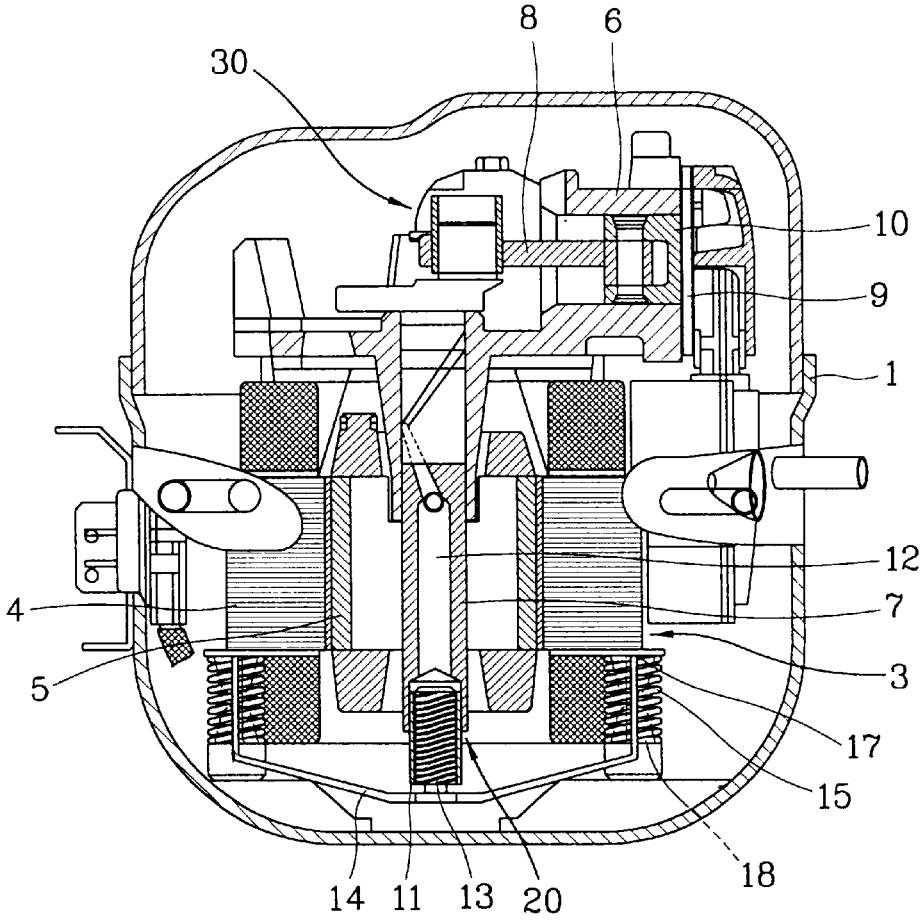
FIG. 1 CONVENTIONAL ART
FIG. 1 is a vertical sectional view showing a hermetic compressor in accordance with a conventional art.
Figure 2:
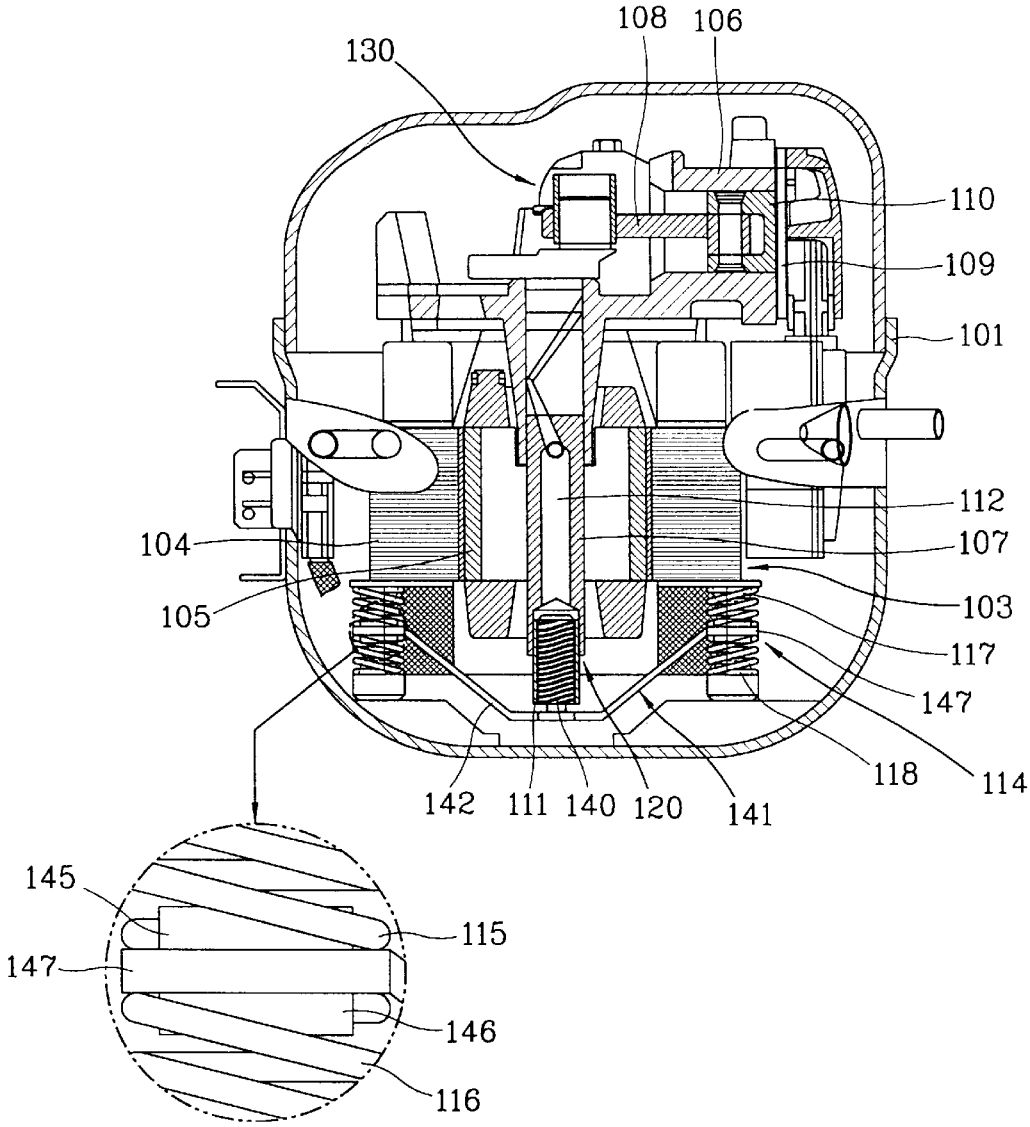
FIG. 2 is a vertical sectional view showing a hermetic compressor in accordance with a preferred embodiment of the present invention.

FIG. 2 is a vertical sectional view showing a hermetic compressor in accordance with a preferred embodiment of the present invention.

A hermetic compressor of the present invention includes: a hermetic container 101 forming a space therein; a driving motor 103 installed inside the hermetic container 101 and providing a driving force; a compressing unit 130 for compressing the fluid with the driving force of the driving motor 103; and an oil supply apparatus 120 for supplying oil into the hermetic container 101 to perform a lubricating and cooling operation.

The driving motor 103 includes a stator 104 wound with an exciting coil; and a rotor 105 made of a permanent magnet.

When power is applied to the stator 104, a rotational force is generated due to the electromagnetic interaction between the stator 104 and the rotor 105.

A support spring 114 is installed between the stator 104 and the bottom surface of the hermetic container 101 so as to elastically support the driving motor.

The support spring 114 is formed by being divided into an upper spring 115 mounted at a spring support 117 mounted at a lower surface of the stator 104, and a lower spring 116 mounted at a spring seat 118 mounted at a bottom surface of the hermetic container 101, and the oil supply apparatus 120 is supported between the upper spring 115 and the lower spring 116.

A compression coil spring is preferably used as the upper spring 115 and the lower spring 116.

The compressing unit 130 includes: a crank shaft 107 rotated by being connected to the rotor 105 of the motor 103 and having an eccentric portion at its upper portion; a connecting rod 108 for transferring a rotational force of the crank shaft 107; a piston 110 connected to the connecting rod 108 so as to make a reciprocal movement to compress oil; a cylinder 106, in which the piston 110 is inserted so as to be able to make a reciprocal movement, forming a compressing chamber; and a valve assembly 109 mounted at a front side of the cylinder 106 and opening and closing a compressed fluid.

The oil supply apparatus 120 includes a sleeve 111 coupled at a lower end of the crank shaft 107 and being rotated together with the crank shaft 107; an oil flow path 112 formed inside the crank shaft 107, a sucking member 140 disposed to maintain a certain gap against an inner circumferential face of the sleeve 111 inside the sleeve 111 and sucking oil into the oil flow path 112 thanks to the interaction with the sleeve 111; and a support bracket 141 for rendering the sucking member 140 to be supported by the support spring 114 so that the sucking member 140 is maintained in a suspended state inside the sleeve 111. The sleeve 111, having a cylindrical form, is connected to a lower side of the crank shaft 107 and rotated together with the crank shaft 107, of which an end portion is soaked in oil filled at the lower portion of the hermetic container 101. The sucking member 140 is disposed to maintain the certain gap against the sleeve at the inner circumferential face of the sleeve 111, and a spiral flow path is formed at an outer circumferential face so as to allow a suction force so that the oil can be sucked upwardly when the sleeve 111 is rotated.

Figure 3:
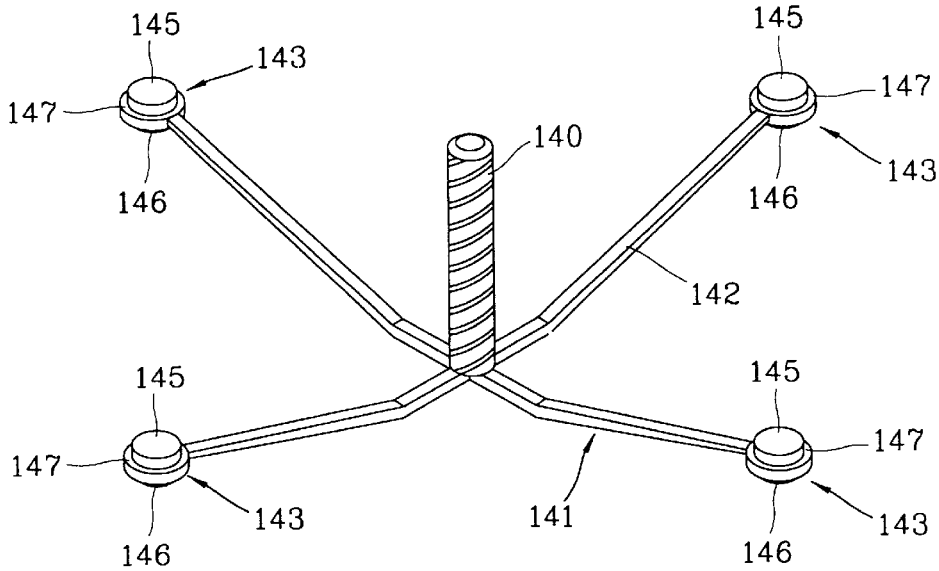
FIG. 3 is a perspective view showing a support bracket in accordance with the preferred embodiment of the present invention.

As shown in FIG. 3, the support bracket 141 includes a plurality of legs 142 formed extended in a radial form at a lower surface of the sucking member 140; and a seat cap 143 formed at the end portion of the legs 142 and inserted between the upper spring 115 and the lower spring 116.

The leg 142 has a rod form with a certain thickness fixed at a lower surface of the sucking member 140 and extended in an outer direction, one side of which is bent upwardly and connected to the seat cap 143 and made of a material having an elastic force.

The seat cap 143 includes: a support portion 147 formed in a circle shape at the end portion of the leg 142; an upper protrusion 145 formed upwardly of the support portion 147 and mounted at a lower end of the upper spring 115; and a lower protrusion 146 formed at a lower side of the support portion 147 and mounted at the upper end of the lower spring 116.

Figure 4:
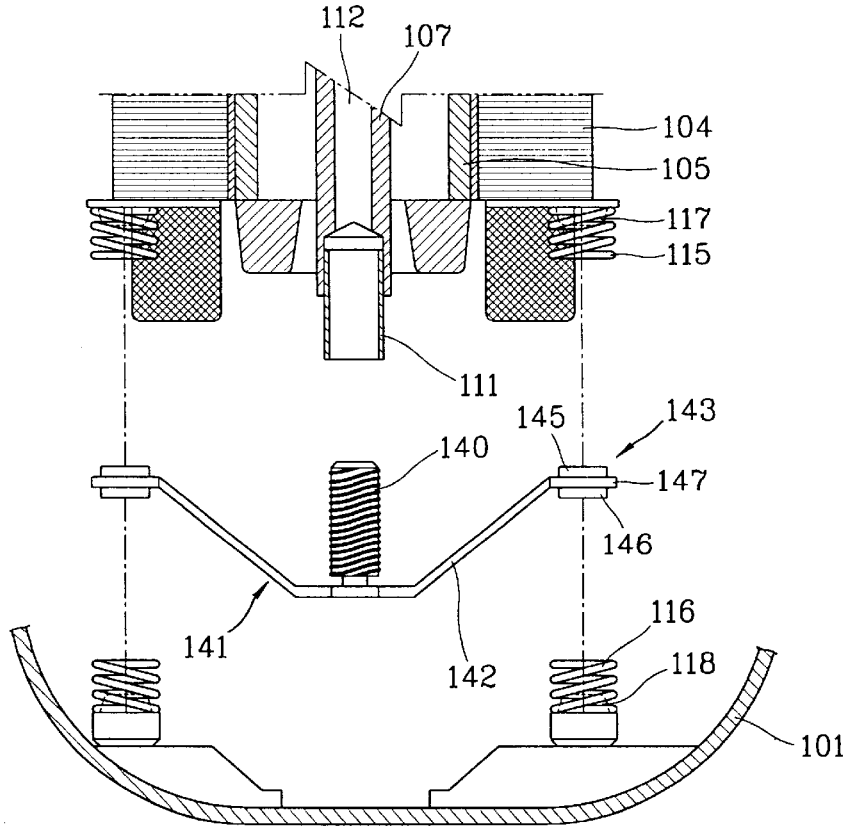
FIG. 4 is an exploded side view showing an oil supply apparatus in accordance with the preferred embodiment of the present invention.

The assembly process of the oil supply apparatus for a hermetic compressor in accordance with the present invention will now be described. FIG. 4 is an exploded side view showing an oil supply apparatus in accordance with the preferred embodiment of the present invention.

As shown in FIG. 4, first, the sleeve 111 is press-fit at the lower inner circumferential face of the crank shaft 107, and the support bracket 141 is fixed at a lower side of the sucking member 140.

The seat cap 143 of the support bracket 141 is fixed between the upper spring 115 installed at the spring supporter 117 mounted at the lower end portion of the stator 104, and the lower spring 116 mounted at the spring seat 118 mounted at the bottom surface of the hermetic container 101, so that the sucking member 140 is disposed inside the sleeve 111 and the assembling is completed.

Accordingly, the sleeve 111, the sucking member 140 and the support bracket 141 can be assembled such that the motor 103 and the compressing unit 130 are assembled as one body.

In addition, since the seat cap 143 of the support bracket 141 is mounted and fixed between the support springs 114, the operation of the assembly is simplified.

The operation of the hermetic compressor will now be described.

First, when the motor 103 is rotated, the crank shaft 107 is rotated to transmit a driving power to the compressing unit 130, thereby compressing a fluid.

Meanwhile, when the crank shaft 107 is rotated according to the rotation of the motor 103, the sleeve 111 is rotated and the sucking member 140 is supported by the support bracket 141 so that the sucking member 140 can maintain a certain gap against the inner circumferential face of the sleeve 111. Thus, the oil filled inside the hermetic container 101 is sucked along the spiral flow path formed at the outer circumference of the sucking member 140 by the relative rotation of the sleeve 111.

The sucked oil performs a lubricating operation on the sliding part and a frictional portion inside the compressor.

At this time, since the seat cap 143 of the support bracket 141 supporting the sucking member 140 is installed between the support springs and the vibration generated from the driving motor 103 is absorbed to the support spring 114, the vibration is prevented from being directly transferred to the sucking member 140.

Accordingly, as the sucking member 140 maintains a certain gap against the inner circumferential face of the sleeve 111, it can stably suck the oil.

As so far described, the oil supply apparatus for a hermetic compressor of the present invention has many advantages.

That is, for example, first, since the plurality of legs are fixed between the support springs by mounting the seat cap therebetween, the assembly of the sleeve and the sucking member can be simply assembled in a state that the motor and the compressing unit has been already assembled as one body. Thus, its assembling operation is simplified and an efficiency of the assembly operation can be improved.

Secondly, since the sucking member disposed inside the sleeve is stably fixed by the plurality of legs, the sucking member can maintain a certain gap against the inner circumferential face of the sleeve. Thus, oil sucking can be more smoothly performed.

Lastly, since the vibration generated from the motor is absorbed to the support spring, the vibration is prevented from being directly transferred to the sucking member through the support bracket. Thus, the sucking member can maintain a certain gap against the inner circumferential face of the sleeve, thereby improving a reliability of oil sucking.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. An oil supply apparatus for a hermetic compressors, comprising:

a crank shaft configured to be coupled to a rotor of a driving motor so that the crank shaft and the rotor rotate together;

a sleeve coupled to a lower end of the crank shaft, so that the sleeve and the crank shaft rotate together;

a sucking member configured to be inserted into the sleeve and to maintain a predetermined gap between the sucking member and an inner circumferential surface of the sleeve;

a plurality of support spring assemblies configured to be installed between a lower inner surface of a hermetic container and a stator of the driving motor; and a support bracket coupled to a lower end portion of the sucking member and installed at a middle portion of the support spring assemblies so as to maintain the sucking member in a suspended state inside the sleeve.

2. The oil supply apparatus of claim 1, wherein each support spring assembly comprises:

a spring support mounted on a lower surface of the stator;

a spring seat mounted on a lower inner surface of the hermetic container;

an upper spring mounted on the spring support; and a lower spring mounted on the spring seat.

3. The oil supply apparatus of claim 2, wherein the support bracket comprises:

a plurality of legs radially extended from the lower end portion of the sucking member; and a seat cap formed at an end portion of each of the plurality of legs, wherein the seat cap is configured to be assembled between a respective upper and lower spring.

4. The oil supply apparatus of claim 3, wherein each of the plurality of legs is formed with a predetermined thickness wherein one end portion of each leg is bent in an upward direction, and wherein each of the legs comprises an elastic a material.

5. The oil supply apparatus of claim 3, wherein each seat cap comprises:

a substantially circular support portion formed protruded from an end portion of the respective leg;

an upper protrusion formed protruded from an upper surface of the support portion and configured to be mounted on a lower end of the upper spring; and a lower protrusion formed protruded from a lower surface of the support portion and configured to be mounted on an upper end of the lower spring.

6. The oil supply apparatus of claim 1, wherein the sucking member further comprises an oil flow groove formed in a spiral along an outer circumferential surface of the sucking member.

7. The oil supply apparatus of claim 6, wherein the sucking member is further configured to suck oil from the hermetic container into a first oil flow path formed by an inner circumferential surface of the sleeve and the oil flow groove of the sucking member, and to convey the oil from the first oil flow path into a second oil flow path formed in the crank shaft.

8. An oil supply apparatus for a hermetic compressor, comprising:

a driving motor;

a plurality of spring supporters coupled to and supporting the motor;

a crank shaft coupled to the motor;

a sleeve coupled to an inner circumferential surface of the crank shaft;

a sucking assembly having a first portion configured to be partially inserted into the sleeve and a second portion coupled to and primarily supported by the plurality of spring supporters.

9. The oil supply apparatus of claim 8, wherein the sleeve and the crank shaft rotate together.

10. The oil supply apparatus of claim 8, wherein the first portion of the sucking assembly comprises a sucking member configured to be inserted into the sleeve and to maintain a predetermined gap between an outer circumferential surface of the sucking member and an inner circumferential surface of the sleeve.

11. The oil supply apparatus of claim 8, wherein the second portion of the sucking assembly comprises a support bracket coupled to middle portions of the plurality of spring supporters.

12. The oil supply apparatus of claim 11, wherein the support bracket is formed extended from a lower end portion of the sucking member.

13. The oil supply apparatus of claim 8, wherein each of the plurality of spring supporters comprises:

a spring support mounted on a lower surface of the motor;

a spring seat mounted on a lower inner surface of a hermetic container;

an upper spring mounted on the spring support; and a lower spring mounted on the spring seat.

14. The oil supply apparatus of claim 13, wherein the second portion of the sucking assembly comprises a support bracket that is mounted between the upper and lower springs of the spring supporters.

15. The oil supply apparatus of claim 14, wherein the support bracket comprises:

a plurality of legs formed radially extended from a lower end portion of the first portion of the sucking member;

a seat cap formed extended from an end portion of each of the plurality of legs, wherein each seat cap is configured to be installed between an upper spring and a lower spring of one of the plurality of spring supporters.

16. The oil supply apparatus of claim 15, wherein each seat cap comprises:

a support portion formed at an end portion of a leg;

an upper protrusion formed on an upper surface of the support portion; and a lower protrusion formed on a lower surface of the support portion.

17. The oil supply apparatus of claim 16, wherein the upper protrusion is configured to be mounted on a lower end of the upper spring, and the lower protrusion is configured to be mounted on an upper end of the lower spring.

18. A hermetic compressor comprising the oil supply apparatus of claim 8.

19. An oil supply apparatus for a hermetic compressor, comprising:

a sucking member configured to be inserted into a rotating shaft of a hermetic compressor; and a support bracket coupled to the sucking member, wherein the support bracket comprises a plurality of legs with each leg of said plurality of legs being mounted between a corresponding plurality of support springs that also support the hermetic compressor.

* * * * *